US005155874A

United States Patent [19]

Kershaw

[11] Patent Number: 5,155,874

[45] Date of Patent: Oct. 20, 1992

[54] TURN SHEET FOR INVALID

[76] Inventor: Juanita Kershaw, 1515 Grace, Kankakee, Ill. 60901

[21] Appl. No.: 749,918

[22] Filed: Aug. 26, 1991

[51] Int. Cl.[5] ..... A61G 7/10

[52] U.S. Cl. ..... 5/81.1

[58] Field of Search ..... 5/81.1, 83.1, 85.1, 5/86.1, 87.1, 88.1, 482, 495

[56] References Cited

U.S. PATENT DOCUMENTS

| | | | |
|---|---|---|---|
| 1,334,901 | 3/1920 | Higdon | 5/81 R |
| 2,812,514 | 3/1955 | Pruitt | 5/61 |
| 3,284,816 | 1/1965 | Laubsch | 5/81 R |
| 3,383,717 | 5/1968 | Underwood | 5/61 |
| 4,092,748 | 6/1978 | Ewers | 5/82 R |
| 4,180,879 | 1/1980 | Mann | 5/508 |
| 4,536,903 | 8/1985 | Parker | 5/61 |
| 4,675,925 | 6/1987 | Littleton | 5/61 |
| 4,793,008 | 12/1988 | Johansson | 5/81 R |
| 4,908,889 | 3/1990 | Lonardo | 5/81 R |
| 5,068,931 | 12/1991 | Smith | 5/61 |

OTHER PUBLICATIONS

Hoyer Patient Lifters Brochure, Available from Everest & Jennings, Inc. 3233 East Mission Daks Blvd. Camarillo CA. 93010.

*Primary Examiner*—Alexander Grosz

*Attorney, Agent, or Firm*—Wood, Phillips, VanSanten, Hoffman and Ertel

[57] ABSTRACT

A turn sheet for turning an invalid from a back rest position to a side rest position is disclosed, along with a method for its use and a system for so turning an invalid patient. The turn sheet is rectangular and has rows of reinforced holes running between the side edges of the sheet and a pair of sleeves. One of the sleeves holds a rigid rod. The turn sheet is used in combination with a lift device of the type supplying an upward lifting force. The lift device is connected to lift the side edge of the sheet near the rigid rod. The patient, laying on the turn sheet on the bed, may be turned from a back rest position to a side rest position by applying the lifting force to raise one side edge.

11 Claims, 1 Drawing Sheet

TURN SHEET FOR INVALID

BACKGROUND OF THE INVENTION

The present invention relates to a turn sheet for invalids. More specifically, the present invention provides a method, system and sheet for turning invalid patients from a back rest position to a side rest position, holding the patient in the side rest position for a period of time, and returning the patient to the back rest position.

In caring for the bedridden patient, it is necessary to frequently change the patient's position in the bed to prevent bed sores and other maladies associated with lying in one position for an extended period of time. In such cases, it is desirable to change the patient's position from a back rest position to side rest positions, with the patient resting alternately on either side for a period, followed by a return to the back rest position for another period. In addition, the patient's position in the bed is frequently changed when washing the patient and when changing bed linens. In providing this care, it is also frequently necessary to turn the patient from the back rest to the side rest position and to position the patient on alternate sides of the mattress. Furthermore, with patients requiring long term care, in particular, the patient may experience a disabling freezing of the joints due to the long term immobilization, reducing the patient's freedom of movement. In caring for such a patient, it is desirable to allow for movement of the patient's arms and legs, to use the joints such as the shoulder.

In providing such care, caretakers and patients often experiences difficulties. Because of the size and weight of the patient, it may be difficult for the caretakers to turn the patient without injuring themselves, and it may be necessary for other caretakers to assist in the turning operation. The need for additional caretakers may make it more difficult for the patient to cared for in the home. Furthermore, it may be difficult for the caretakers to turn the patient without causing injury, pain or discomfort to the patient. This difficulty is particularly important in the case of a patient suffering from a spinal ailment, where any bending of the patient's torso could cause pain or injury. In addition, the patient may not have sufficient strength or mobility to hold him or herself in the side rest position without some support for the back, such as provided by a pillow. These problems are exasperated by the frequency with which such patients must be turned from one position to another.

Various forms of sheets have been proposed in the art for dealing with the problem of turning the bedridden patient. However, the prior art proposals have not fully solved the problems involved in providing a convenient means of turning a bedridden patient while avoiding injury or discomfort to the patient and the caretaker.

Patient lift devices have been known in the art. Such devices have been used for transporting patients from one place to another, as from a bed to a wheelchair, from a wheelchair to an automobile, bathtub, swimming pool, or commode. Such patient lift devices have the advantage of using mechanical or hydraulic jacks or motors to supply a vertical lifting force, rather than relying upon the brute strength of the caretaker. However, such devices have not heretofore been used in combination with a turn sheet for turning a patient from a back rest position to a side rest position in a bed.

SUMMARY OF THE INVENTION

It is an object of the present invention to minimize the potential for injury or discomfort to a bedridden patient in turning the patient from a back rest to a side rest position and in holding the patient in a side rest position.

It is a further object of the invention to allow a bedridden patient to be turned by a single caretaker from a back rest to a side rest position and from a side rest to a back rest position.

It is a further object of the present invention to minimize the potential for injury to a caretaker in turning a bedridden patient from a back rest position to a side rest position.

It is a further object of the present invention to facilitate turning a bedridden patient from a back rest to a side rest position.

It is a further object of the present invention to provide a method, system and turn sheet for turning a bedridden patient to facilitate cleaning of the patient, changing of the bed linens, movement of the patient's limbs, and to prevent bedsores.

It is a further object of the present invention to provide a method and system for turning a bedridden patient from a back rest position to a side rest position, and to hold the patient in the side rest position for a period of time.

It is a further object of the present invention to provide a turn sheet for use in turning a bedridden patient from a back rest position to a side rest position, and in holding the patient in the side rest position for a period of time.

It is a further object of the present invention to prevent disabling of the bedridden patient's joints due to immobilization of the joints and limbs for an extended period of time.

It is a further object of the present invention to provide such a method, system and sheet which allows freedom of movement of the patient's arms, shoulders and legs when the patient is in the side rest position.

It is a further object of the present invention to minimize any bending of the patient's torso when turning the patient from a back rest to a side rest position.

It is a further object of the present invention to provide such a method, system and sheet which distributes the turning force substantially evenly along the length of the patient's spinal column when the patient is turned and held in the side rest position.

It is a further object of the present invention to provide such a method, system and sheet which utilizes a vertical lifting force to turn the patient from a back rest to a side rest position.

It is a further object of the present invention to provide such a method, system and sheet which does not rely upon the strength of the caretaker to turn the patient from a back rest to a side rest position.

The foregoing objects of the invention are met by the present invention. In one aspect, the present invention comprises a method of turning a bedridden patient from a back rest position to a side rest position. The method comprises the steps of providing a bed, a turn sheet and a lift device. The lift device is of the type which provides an upward lifting force. The turn sheet includes a pair of parallel side edges. Each side edge has a length greater than the length of the patient's torso. The sheet is laid on the bed so that the turn sheet side edges are substantially parallel to the side edges of the bed, and the patient lays down upon the sheet in the back rest position, with the patient's spinal column substantially parallel to the sheet side edges. The turn sheet is dimensioned so that the side edges extend from below the patient's hips to above the patient's shoulders. The lift device is then connected to the turn sheet near one side edge of the turn sheet. The patient lift device is then used to apply an upward lifting force near the side edge to raise the side edge of the turn sheet to a height to turn the patient to the desired side rest position. The lift device may then be secured to hold the turn sheet side edge at the height at which the patient is in the desired side rest position for a desired period of time.

In another aspect, the present invention provides a turn sheet for turning an invalid from a back rest position to a side rest position in a bed. The turn sheet comprises a quadrilateral sheet having a pair of parallel sleeves spaced from and parallel to the side edges of the sheet. A plurality of reinforced holes are disposed in rows between each sleeve and each parallel edge, and a rigid bar extends through one of the sleeves. The length of the rigid bar is at least as great as the length of the torso of the invalid and less than the length of the bed, and the rigid bar is held along its length by the sleeve.

In yet another aspect, the present invention provides a system for turning a patient in bed from a back rest position to a side rest position. The system comprises a turn sheet and a patient lift device. The turn sheet comprises a quadrilateral sheet having a pair of parallel sleeves spaced from and parallel to a pair of side edges, each sleeve extending the length of each parallel side edge. A rigid bar extends through the one of the sleeves the length of the side edges, and a plurality of reinforced holes are disposed between each sleeve and each parallel edge, one reinforced hole being disposed near each corner of the sheet, with the remaining reinforced holes being spaced along the sleeves between the corner holes. The patient lift device includes an arm extending over the bed to a free end spaced above the bed and means for raising and lowering the free end of the arm. Means are provided for connecting the free end of the arm to the reinforced holes along the side edge of the turn sheet nearest the rigid bar so that the side edge of the turn sheet may be raised to turn a patient resting thereon from a back rest position to a side rest position and may be lowered to return the patient to a back rest position by raising and lowering the free end of the arm of the patient lift device.

The foregoing and other objectives and advantages of the present invention will become apparent from the following detailed description, considered in conjunction with the accompanying drawings.

DETAILED DESCRIPTION OF THE ILLUSTRATED EMBODIMENT

Figure 1:
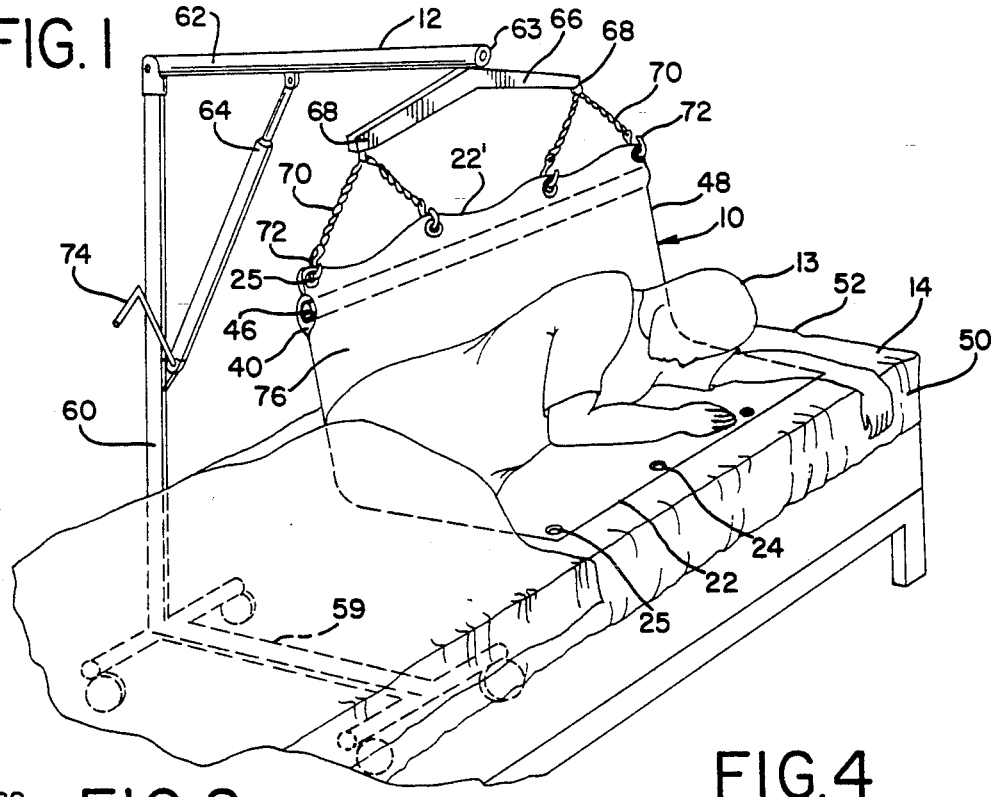
FIG. 1 is a partial perspective view of a patient turned to and held in a side rest position on a bed, utilizing the turn sheet of the present invention in combination with a patient lift device.
Figure 2:
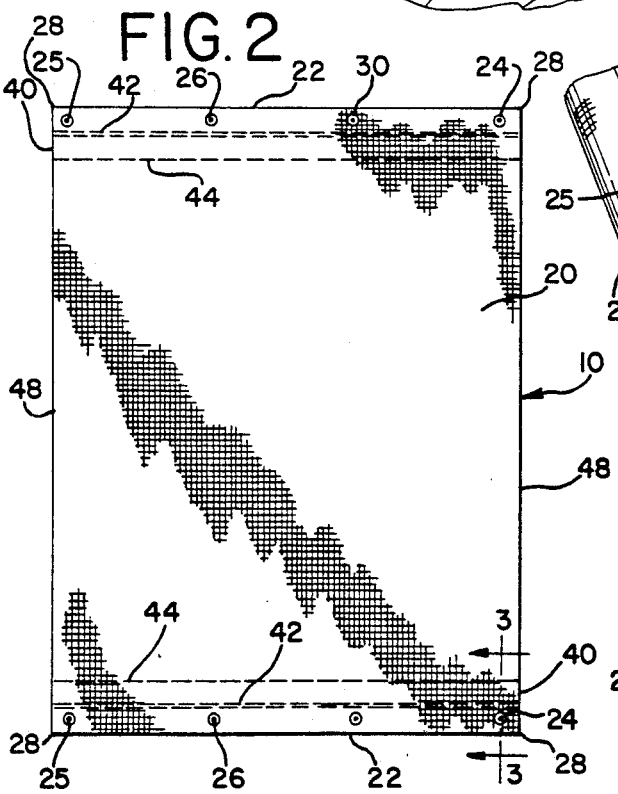
FIG. 2 is a plan view of the turn sheet of the present invention.
Figure 4:
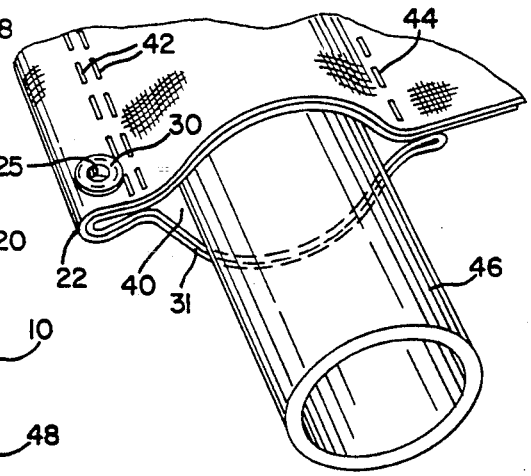
FIG. 4 is an enlarged fragmentary perspective view of the sleeve of the turn sheet of the present invention with a rigid tubular rod in place within the sleeve.

Referring to FIGS. 1 and 2 in the accompanying drawings, the turn sheet 10 of the present invention is intended to be used together with a patient lift device 12 of the type which supplies a vertical lifting force. In combination, the turn sheet 10 and lifting device 12 may be used to turn an invalid or bedridden patient 13 from a back rest position, wherein the patient lies flat on his or her back on a bed 14, to a side rest position, as shown in FIG. 1, wherein the patient lies on his or her side. The combination turn sheet 10 and lifting device 12 will hold the patient in the side rest position for a period of time, after which the caretaker may lower the turn sheet and lifting device to return the patient to the back rest position. Later, the patient may be turned to rest on the opposite side.

As shown in FIG. 2, the turn sheet 10 is a generally flat rectangular sheet 20 of heavy gauge canvas fabric. Along the shorter side edges 22 of the sheet, linear rows 24 of reinforced holes are provided. In the illustrated embodiment, reinforced holes 25 are provided at the corners 28 of the sheet 20, and two additional holes 26 are evenly spaced between the corner holes along each sheet side edge 22, providing four reinforced holes along each side edge 22 of the sheet.

Figure 3:
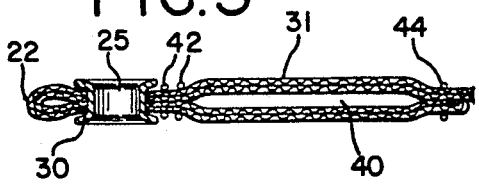
FIG. 3 is a cross sectional view, taken along line 3—3 of FIG. 2, showing one of the side edges of the turn sheet of the present invention.

As illustrated in FIG. 3, each reinforced hole 25, 26 includes a grommet 30. Each grommet 30 comprises a metal eyelet having an overall diameter of about one inch, and defining a central bore having a diameter of about one-half inch. As there shown, the fabric is twice folded over upon itself, as shown at 31, at each side edge 22 of the sheet 20, and each grommet extends through the four layers of fabric. The edge of each grommet is spaced about one-quarter inch from the adjacent turn sheet side edge 22.

Inward of the row of reinforced holes 24 are a pair of sleeves 40 formed in the sheet 20. The sleeves are parallel to each other and to the sheet side edges 22, and extend the length of each sheet side edge. As illustrated in FIG. 3, the sleeves 40 are formed by the twice-folded fabric 31 and stitching, including a double line of parallel stitches 42 sewn between each row of reinforced holes 24 and each sleeve, and a single line of stitches 44 sewn spaced from and parallel to the double line of stitches 42. The spacing between the lines of stitches 42, 44 is great enough to define a sleeve having a diameter sufficient to tightly hold a rigid reinforcing rod 46 within the sleeve. In the illustrated embodiment, the spacing between the lines of stitches 42, 44 is about two inches, and the twice folded fabric has a width of about four inches.

The rigid bar or rod 46 may be a tubular piece of metal or a solid wooden cylinder. Each rod is one-piece, and extends the length of each sleeve 40, between the long edges 48 of the sheet 20. The rod should be sufficiently rigid to maintain the edge of the sheet in a straight line when a vertical lifting force is applied to the reinforced holes to turn the patient. Since only one side edge of the sheet will be used at a time to turn the patient from one position to another, it is not necessary to supply more than one rod; the rod may be slipped in and out of each sleeve, depending upon the direction in which the patient is being turned. In the illustrated embodiment, the rod is a metal tube having a diameter of about one inch.

The overall dimensions of the illustrated rectangular sheet 20 are as follows: width between side edges 22 of sheet, about 48 inches; distance between single stitch lines 44, about forty inches; distance between long edges 48 of sheet, about thirty-six inches. The particular dimensions are not critical, although it is preferred that the width of the sheet between the long edges be sufficient to extend the length of the spinal column of the patient, and that the length of the sheet between side edges be sufficient to extend to near the long side edges 50 of the bed 14.

As shown in FIG. 1, the turn sheet 10 is laid on the rectangular bed 14 with the side edges 22 of the sheet extending generally parallel to the long side edges 50 of the bed. The sheet is not centered on the bed, but placed more near to the head 52 of the bed than the foot (not shown), so that when the patient 13 is placed on the turn sheet 10, the patient's entire torso, from the neck to the hips, is on the turn sheet, with the spinal column being generally parallel to and midway between the side edges 22 of the sheet.

To turn the patient from the back rest position to the side rest position as shown in FIG. 1, the rigid reinforcing rod 46 is slipped into one sleeve 40, and the turn sheet is attached to the patient lift device 12 through one row 24 of reinforced holes 25, 26 along the sleeve containing the rod. The patient lift device is then used to apply an upward lifting force to these reinforced holes to lift one side edge 22 of the sheet, while the other sheet side edge remains on the bed. As the one sheet side edge is lifted to the position shown at 22' in FIG. 1, the lifting side of the sheet turns the patient from the back rest position to the side rest position. The lifting force from the patient lift device is not applied directly to the rigid rod or bar 46; instead the vertical lifting force is applied directly to the reinforced holes 25, 26, and the bar or rod serves to spread the lifting force along the length of the rod, to maximize comfort for the patient and prevent the application of excess pressure on a localized area of the torso. Thus, the patient's spine is not bent when the patient is turned, reducing the possibility of injury or pain to the patient.

To maximize patient comfort, prevent undue stress on the patient, to allow for the patient to be turned by a single caretaker, and to minimize caretaker fatigue, stress and injury, the turn sheet of the present invention in used in combination with a mechanical, hydraulic or motorized lift device 12. The lift device is of the type supplying a generally vertical lifting force through an overhanging arm having a free end. Means are provided for connecting the free end of the arm to the reinforced holes along the side edge of the turn sheet nearest the rigid bar so that the side edge of the turn sheet may be raised to turn the patient resting thereon from a back rest position to a side rest position and may be lowered to return the patient to a back rest position by raising and lowering the free end of the arm of the patient lift device. Means are also provided for raising and lowering the free end of the arm.

In the illustrated embodiment, the patient lift device 12 is of the type used for transferring patients from bed to chair, commode, car, bathtub or swimming pool. The illustrated lift device is of the type manufactured by Ted Hoyer & Co., 2222 Minnesota Street, P.O. Box 2744, Oskosh, Wis. 54903. Viewed from the side, the patient lift is generally C-shaped, with a wheeled base 59 which will fit under the bed, an upright post 60 attached to one end of the base, an arm 62 pivotally connected to the top of the upright post 60 and having a free end 63, and a telescoping lift member 64 extending between the upright post and the arm. The telescoping lift member 64 is pivotally connected to both the upright post 60 and the arm 62, and is used to raise and lower the free end 63 of the arm. A bar 66 is connected to the free end 63 of the arm 62, and has two free ends 68 to which chains 70 or other suitable means are attached to one row of reinforced holes 24 along one side edge 22 of the turn sheet 10 through S-hooks 72 to serve as connection means. The telescoping lift member 64 may be operated by hydraulic or mechanical jacks 74, or the lift may be of motorized, through the use of a battery operated motor. Generally, whether operated through a jack or through a motor, such lift members may be set or locked to maintain a given vertical position, for transfer of patients. It should be understood that other types of lift devices may be employed with the turn sheet of the present invention to turn patients.

With the lift device connected as shown in FIG. 1, activation of the lift member 64 causes a substantially vertical lifting force to be exerted upon the row 24 of reinforced holes of the turn sheet. The rigid reinforcing rod 46 distributes the force along the length of the sheet side edge 22, minimizing discomfort and potential injury from application of force to a locally sensitive area. Once the patient has been positioned as desired, the lift member may be set or locked to maintain this position, and the vertical force remains distributed along the rod or bar 46. As shown in FIG. 1, the patient retains use of his or her arms and shoulders since the lifted portion of the turn sheet 76 remains behind the patient's back and shoulders. After the patient has been in the desired position for the desired time, the lift member may be used to lower the edge 22' of the turn sheet to return the patient to the back rest position. After a desired interval, the rigid rod may be moved to the opposite sleeve 40; the chains and S-hooks may then be connected to the reinforced holes 25, 26 along that sleeve, and the patient may be turned to rest on his or her other side.

Although this invention has been disclosed and described in its preferred form with a certain degree of particularity, it is understood that the present disclosure of the preferred form is only by way of example and that numerous changes in the details of operation and in the combination and arrangement of parts may be made without departing from the spirit and scope of the invention as hereinafter claimed.

I claim:

1. A turn sheet for turning an invalid from a back rest position to a side rest position in a bed, the turn sheet comprising:

a quadrilateral sheet having a pair of parallel sleeves spaced from and parallel to the side edges of the sheet;

a rigid rod extending through one of the sleeves; and a plurality of reinforced holes disposed in rows between each sleeve and each parallel edge, wherein the length of the rigid rod is at least as great as the length of the torso of the invalid and less than the length of the bed, and the rigid rod is held along its length by the sleeve.

2. A turn sheet as claimed in claim 1 wherein the length of the rigid rod is at least thirty-six inches.

3. A turn sheet as claimed in claim 1 wherein the width of the turn sheet between its side edges is substantially the same as the width of the bed.

4. A turn sheet as claimed in claim 1 wherein the width of the turn sheet between its side edges is great enough so that the reinforced holes are exposed when the invalid is placed on the turn sheet in a back rest position.

5. A turn sheet as claimed in claim 1 wherein the width of the turn sheet between its side edges is about forty-eight inches.

6. A turn sheet as claimed in claim 1 wherein the side edges of the turn sheet have lengths of about thirty-six inches.

7. A turn sheet as claimed in claim 1 wherein the turn sheet comprises a single sheet of fabric, and wherein the fabric is folded upon itself to a thickness of four layers from each side edge to and including the adjacent sleeve.

8. A turn sheet as claimed in claim 7 wherein each reinforced hole includes a grommet extending through each layer of fabric.

9. A system for turning a patient in bed from a back rest position to a side rest position, the system comprising:

a turn sheet comprising a quadrilateral sheet having a pair of parallel sleeves spaced from and parallel to a pair of side edges, each sleeve extending the length of each parallel side edge, a rigid rod extending through the one of the sleeves the length of the side edges, and a plurality of reinforced holes disposed between each sleeve and each parallel edge, one reinforced hole being disposed near each corner of the sheet, with the remaining reinforced holes being spaced along the sleeves between the corner holes;

a lift device including an arm extending over the bed to a free end spaced above the bed and means for raising and lowering the free end of the arm; and means for connecting the free end of the arm to the reinforced holes along the side edge of the turn sheet nearest the rigid rod so that the side edge of the turn sheet may be raised to turn a patient resting thereon from a back rest position to a side rest position and may be lowered to return the patient to a back rest position by raising and lowering the free end of the arm of the lift device.

10. A system as claimed in claim 9 wherein the free end of the arm of the lift device is positioned vertically substantially above the patient in the bed.

11. A system as claimed in claim 9 wherein a portion of the turn sheet extends upwardly across the patient's back toward the free end of the lift device arm when the patient is in the side rest position to support the patient's back in the side rest position.

* * * * *